US006496150B1

(12) United States Patent
Li et al.

(10) Patent No.: US 6,496,150 B1
(45) Date of Patent: Dec. 17, 2002

(54) DECOUPLING BETWEEN PLURAL ANTENNAS FOR WIRELESS COMMUNICATION DEVICE

(75) Inventors: Kevin Li, San Diego, CA (US); Zhan Li, San Diego, CA (US); Francis Daniel McGaffigan, Escondido, CA (US); Faton Tefiku, San Diego, CA (US)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/896,151

(22) Filed: Jun. 29, 2001

(51) Int. Cl.[7] ..... H01Q 1/24; H01Q 21/00
(52) U.S. Cl. ..... 343/702; 343/725; 343/850
(58) Field of Search ..... 343/702, 700 MS, 343/725, 729, 749, 750, 751, 850, 853

(56) References Cited

U.S. PATENT DOCUMENTS 5,486,836 A * 1/1996 Kuffner et al. ..... 343/700 MS
5,940,040 A * 8/1999 Koyanagi et al. ..... 343/702
6,204,819 B1 * 3/2001 Hayes et al. ..... 343/702
6,211,830 B1 * 4/2001 Monma et al. ..... 343/702
6,225,951 B1 * 5/2001 Holshouser et al. . 343/700 MS
6,326,924 B1 * 12/2001 Muramoto et al. ..... 343/702

* cited by examiner

*Primary Examiner*—Hoang Nguyen
(74) *Attorney, Agent, or Firm*—Milan Patel; Tom Weber

(57) ABSTRACT

An electronic device having multiple antennas and capable of operating in a wireless communication system, where interference between the multiple antennas is minimized using a detuning circuit activated by one or more antennas and resulting in detuning of at least one of the antennas. Activation of the detuning circuit can be accomplished by positioning an antenna to complete the detuning circuit and thereby activate the detuning circuit.

19 Claims, 2 Drawing Sheets

DECOUPLING BETWEEN PLURAL ANTENNAS FOR WIRELESS COMMUNICATION DEVICE

FIELD OF THE INVENTION

The present invention relates to an electronic device having multiple antennas and, more particularly to an electronic device for reducing interference between the multiple antennas by engaging a decoupling electronic circuit for the electronic device operable in a wireless communication system.

BACKGROUND OF THE INVENTION

A communication system is operable to communicate information between a transmitting station, also referred to as a calling party, and a receiving station, also referred to as a receiving or called party, by way of a communication network. Operation of a wireless communication system transfers information between the transmitting and receiving stations via one or more base stations. These transmitting and receiving stations are also known as wireless communication devices, cell phones or mobile phones, Personal Digital Assistants (PDA's), or portable computers. As the capability and sophistication of the wireless communication system has increased, the demand for mobile communication devices having at least two antennas has proliferated. Previous mobile communication devices having multiple antennas utilize an electrical or mechanical switch to provide an RF signal to one of the multiple antennas, thereby providing an active antenna. However, the non-active antennas on the mobile communication device can degrade the performance of the active antenna. Among the concerns for locating multiple antennas within a limited space of a mobile communication device is the interference, or coupling between the antennas. Typical solutions include greater separation between the antennas to minimize the interference. Consequently, the relatively small dimensions of the mobile communication device restricts the available separation of the antennas. It would be useful to provide decoupling, also called detuning, or changing resonant frequency, of multiple antennas of a mobile communication device, while achieving sufficient gain and impedance matching of the antennas.

SUMMARY OF THE INVENTION

The present invention encompasses an electronic device having multiple antennas detuned to minimize interference and operable in a wireless communication system, where the electronic device can comprise a mobile station, a personal digital assistant (PDA) or a portable computer. The apparatus of the present invention comprises an internal antenna, an exterior antenna, and a detuning circuit to alter resonant frequency of the inactive antenna and thereby minimize interference between the antennas. Detuning circuitry may cooperate with either the interior antenna or the exterior antenna to minimize interference during operation of the electronic device. In addition, activation of the detuning circuit can be by achieved by positioning the exterior antenna to cooperate with the detuning circuit.

A more complete appreciation of all the advantages and scope of the present invention can be obtained from the accompanying drawings, the following detailed description of the invention and the appended claims.

DETAILED DESCRIPTION OF THE INVENTION

Figure 1:
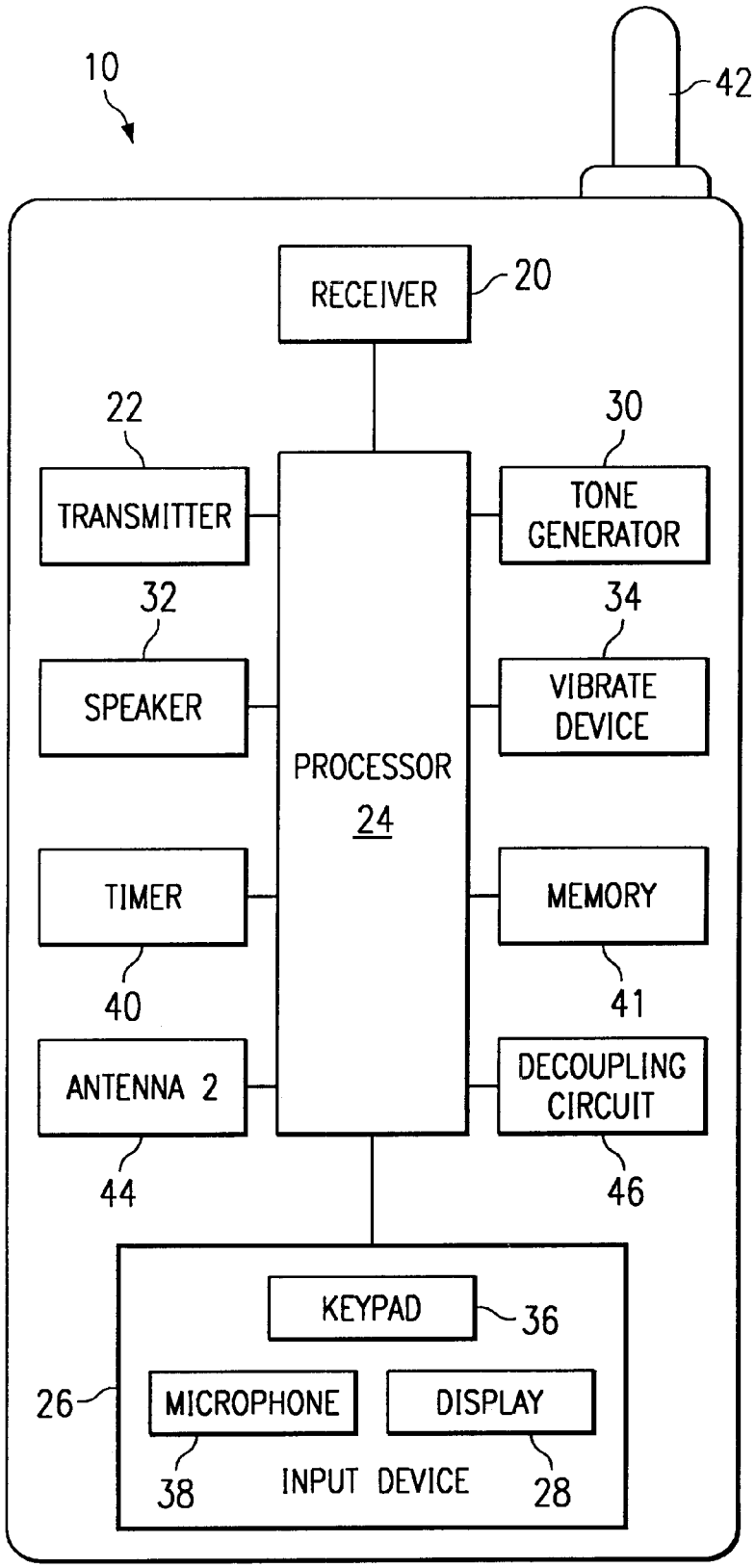
FIG. 1 is an illustration of a mobile station block diagram representing an embodiment of the present invention.

FIG. 1 is a block diagram representing an electronic device of the present invention where a mobile station 10 can be used in conjunction with an embodiment of the present invention. Generally, the mobile station 10 includes a receiver 20, a transmitter 22 and a controller or processor 24 that is coupled to the receiver 20 and the transmitter 22. The receiver 20 sends incoming messages to the processor 24 for analysis, whereas outgoing or originating messages are sent from the processor 24 to the transmitter 22. These incoming and originating messages can be in the form of a voice message, a data message or a combination of voice and data messages.

User interface with the mobile station 10 can be accomplished via an input device 26 which may comprise: a Liquid Crystal Display (LCD) 28 which can contain a touch-screen display (not shown), or a Light Emitting Diode (LED) (not shown); a tone generator 30; a speaker 32; a vibrating device 34; and a data entry device 36. The data entry device 36 can be an alpha-numeric keypad (not shown) and the input device 26 further contains a microphone 38 capable of capturing a voice message. In addition, a timer 40, also known as a clock chip, can be used for synchronizing the operations of the processor 24 and tracking time, a term well known to those of ordinary skill in the art of mobile stations. The mobile station 10 also includes a storage location, illustrated in the embodiment of FIG. 1 as a memory 41, where the memory 41 is capable of storing a plurality of constants and variables used by processor 24 in the operation of the mobile station 10. Communication between the input device 26, the tone generator 30 and the vibrating device 34 is assured by coupling these devices to the processor 24.

In an embodiment according to the invention, the mobile station 10 contains a first antenna 42, a second antenna 44 and a detuning circuit 46. The detuning circuit 46 in accordance with the invention minimizes interference between the first and second antennas, 42 and 44 respectively. The first antenna 42 and the second antenna 44 are capable of transmitting and receiving communication signals in any number of communication frequencies, for example: Global System for Mobile Communication (GSM), Personal Communication System (PCS), Global Positioning System (GPS), Bluetooth, Code Division Multiple Access (CDMA) and W-CDMA. Antennas 42 and 44 can also function as dual-band (i.e. CELL/PCS), tri-banded, quad-banded etc. antennas. An embodiment of the present invention includes the antennas 42 and 44 used as transceivers for data, voice and GPS applications.

In a preferred embodiment, the first antenna 42 is a whip antenna, and the second antenna 44 is an internal antenna. An increase in performance of the antennas 42 and 44, specifically gain and impedance matching, results when using the detuning circuit 46 to alter the resonant frequency of the antenna 42 or 44, connected to the detuning circuit 46.

Figure 2:
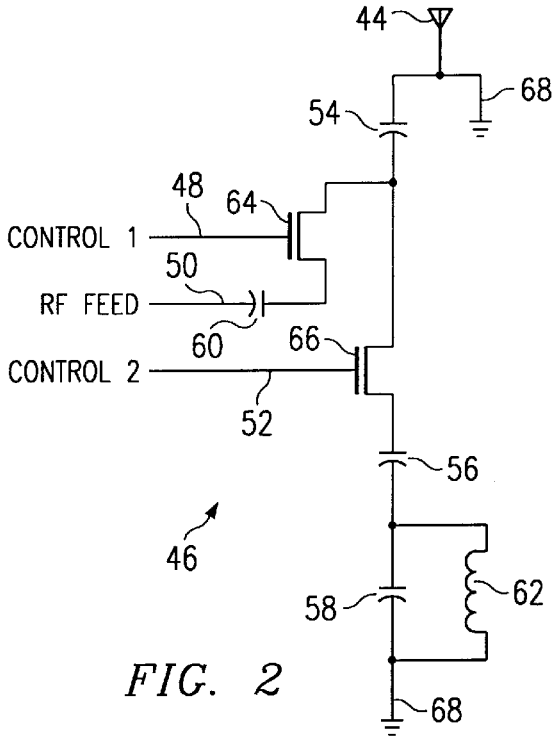
FIG. 2 is a detuning circuit illustrating an embodiment of the present invention.

FIG. 2 illustrates an embodiment of the present invention wherein the second antenna 44 comprises an internal antenna acted upon by the detuning circuit 46. A first digital signal 48, also designated as control 1, an RF feed 50 and a second digital signal 52, also designated as control 2, provide inputs to the detuning circuit 46. In an embodiment of the present invention, the second digital signal 52 is the inverse of the first digital signal 48. The detuning circuit 46 further contains a first capacitor 54, a second capacitor 56, a third capacitor 58, a fourth capacitor 60, an inductor 62, a first switch 64, a second switch 66 and first ground 68. In a preferred embodiment, capacitors 54, 56 and 60 are DC decoupling capacitors and switches 64 and 66 can be either an FET (Field Effect Transistors) switch or a MEMS RF (Micro Electromechanical System) switch. Activation of the second antenna 44 entails closing the first switch 64, and opening the second switch 66. Deactivation of the second antenna 44 entails opening the first switch 64 and closing the second switch 66, thereby engaging the inductor 62 in cooperation with the third capacitor 58 to detune the second antenna 44 by changing the resonance of the second antenna 44. Use of the detuning circuit 46 acts to minimize interference between the first antenna 42 and the second antenna 44.

Figure 3:
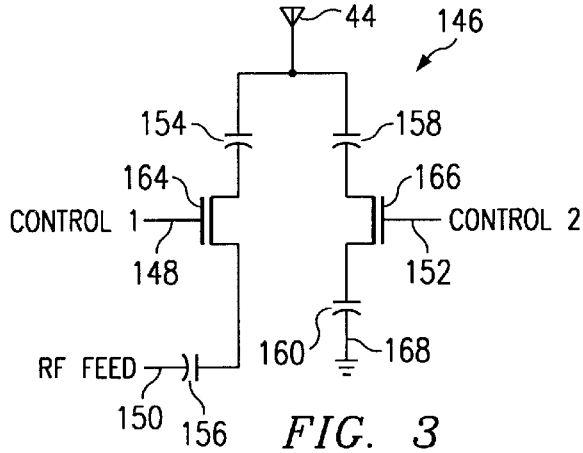
FIG. 3 is a detuning circuit illustrating an alternative embodiment of the present invention.

FIG. 3 illustrates another embodiment of the present invention wherein the second antenna 44 comprises an internal antenna acted upon by the detuning circuit 146. A first digital signal 148, also designated as control 1, an RF feed 150 and a second digital signal 152, also designated as control 2, provide inputs to the detuning circuit 146. In an embodiment of the present invention, the second digital signal 152 is the inverse of the first digital signal 148. The detuning circuit 146 further contains a fifth capacitor 154, a sixth capacitor 156, a seventh capacitor 158, an eighth capacitor 160, a third switch 164, a fourth switch 166 and a second ground 168. In a preferred embodiment, capacitors 154, 156, 158 and 160 are DC decoupling capacitors and switches 164 and 166 can be either an FET (Field Effect Transistors) switch or a MEMS RF (Micro Electromechanical System) switch. Activation of the second antenna 44 entails closing the third switch 164, and closing the fourth switch 166. Deactivation of the second antenna 44 entails opening the third switch 164 and opening the fourth switch 166, thereby removing the connection of the second ground 168 to the second antenna 44. By removing the connection of the second antenna 44 to the second ground 168 the antenna 44 is described as "floating", and thereby detuned. This detuning acts to minimize interference between the first antenna 42 and the second antenna 44.

Note that the embodiments described in FIG. 2 and FIG. 3 describe a detuning circuit, 46 and 146 respectively, acting upon the second antenna 44, wherein switches 64 and 66 must oppose one another (i.e. when switch 64 is closed switch 66 must be open) in embodiment of FIG. 2. However, switches 164 and 166 must act in tandem (i.e. when switch 164 is closed switch 166 must be closed) in embodiment of FIG. 3. In a preferred embodiment the detuning circuits 46 and 146 are activated when the antenna 42 is manipulated to a pre-set position, such as extension of a whip antenna. In distinction to the above embodiments, FIG. 4, described below, involves decoupling the first antenna 42 to minimize interference between the first antenna 42 and the second antenna 44.

Figure 4:
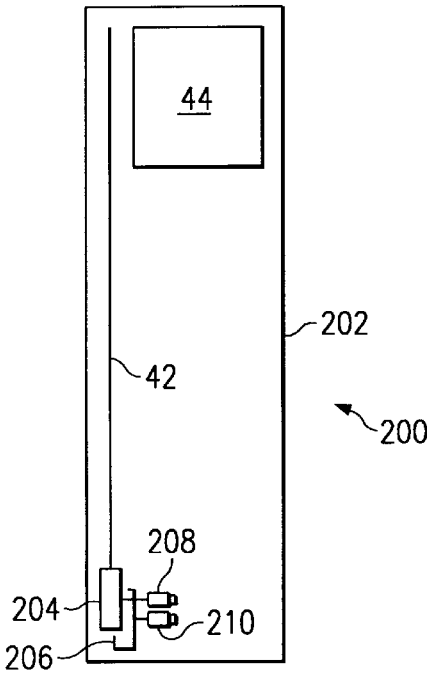
FIG. 4 is a detuning circuit illustrating an alternative embodiment of the present invention.

FIG. 4 illustrates another embodiment of the present invention wherein the first antenna 42 comprises an extendible whip antenna acted upon by a third detuning circuit 208. A PCB (Printed Circuit Board) 202 contains the first antenna 42, the second antenna 44, a connector 204 attached to the first antenna 42, a clip 206, the third detuning circuit 208 and conduit 210 to connect the third detuning circuit 208 to the clip 206. Operation of the first antenna 42 to a retracted position causes the connector 204 to communicate with the conduit 210 and engage the third detuning circuit 208. A shunt inductor circuit forms the third detuning circuit 208 to detune the first antenna 42 and minimize interference between the first antenna 42 and the second antenna 44.

It is understood that various modifications can be made to the mobile station apparatus and method of operation and remain within the scope of the present invention. For example, the protective enclosure may comprise an external or internal antenna to assist transmission and reception of wireless signals.

While preferred embodiments have been discussed and illustrated above, the present invention is not limited to these descriptions or illustrations, and includes all such modifications, which fall within the scope of the invention and claim language presented below.

What is claimed is:

1. An electronic device capable of operation in a wireless communication system, the electronic device comprising:

a first antenna having a first position and a second position, wherein said first antenna is capable of positioning between said first position and said second position;

a second antenna in communication with said first antenna; and a detuning circuit for decoupling interaction between the first and the second antenna, thereby reducing interference between said second antenna and said first antenna, wherein said detuning circuit is activated when said first antenna is in said first position.

2. The electronic device as claimed in claim 1, wherein said second antenna is an internal antenna.

3. The electronic device as claimed in claim 2, wherein said internal antenna comprises a PIFA (Planar Inverted F-antenna).

4. The electronic device as claimed in claim 2, wherein said internal antenna comprises a patch antenna.

5. The electronic device as claimed in claim 2, wherein said internal antenna comprises a loop antenna.

6. The electronic device as claimed in claim 1, wherein said first position comprises a substantially extended position.

7. The electronic device as claimed in claim 1, wherein said detuning circuit comprises a first switch and a second switch, wherein positioning of said first switch is opposite the positioning of said second switch.

8. The electronic device as claimed in claim 7, wherein said first switch comprises a Micro Electromechanical System RF (MEMS RF) switch.

9. The electronic device as claimed in claim 7, wherein said second switch comprises a Micro Electromechanical System RF (MEMS RF) switch.

10. The electronic device as claimed in claim 1, wherein said detuning circuit comprises a first switch and a second switch, wherein positioning of said first switch is unified with the positioning of said second switch.

11. An electronic device capable of operation in a wireless communication system, the electronic device comprising:

a first antenna having a contact portion located generally adjacent a terminus of said first antenna, wherein said first antenna is positioned between a first position and a second position;

a second antenna in communication with said first antenna; and a detuning circuit for reducing interference between said second antenna and said first antenna, wherein said detuning circuit is activated upon engaging said contact portion of said first antenna when positioned in said first position.

12. The electronic device as claimed in claim 11, wherein said first position comprises a substantially extended position.

13. The electronic device as claimed in claim 11, wherein said contact portion comprises a clip.

14. The electronic device as claimed in claim 11, wherein said detuning circuit comprises a shunt inductor.

15. The electronic device as claimed in claim 11, wherein said second antenna is an internal antenna.

16. A method of decoupling multiple antennas of an electronic device capable of operation in a wireless communication system, the steps comprising:

positioning a first antenna in a first position;

establishing communication between a detuning circuit and a second antenna; and activating said detuning circuit upon said first antenna positioning to said first position, whereby interference is reduced between said first antenna and said second antenna.

17. The method as claimed in claim 16, further comprising:

inputting a first digital signal, a second digital signal and an RF signal to said detuning circuit.

18. The method as claimed in claim 16, wherein:

establishing communication between said detuning circuit and said second antenna follows the combination of closing a first switch and opening a second switch.

19. The method as claimed in claim 16, wherein activating said detuning circuit upon said first antenna positioning to said first position follows the combination opening a third switch and opening a fourth switch.

* * * * *